United States Patent [19]

Turner et al.

[11] 4,007,517

[45] Feb. 15, 1977

[54] HEAT TREATMENT OF TEXTILE FABRIC PRIOR TO WET PROCESSING

[75] Inventors: James Keith Turner, Lincolnton; William Cleere Sturkey, Charlotte, both of N.C.; Christoph W. Aurich, Clemson, S.C.

[73] Assignee: Gaston County Dyeing Machine Company, Mount Holly, N.C.

[22] Filed: Aug. 13, 1975

[21] Appl. No.: 604,167

Related U.S. Application Data

[63] Continuation of Ser. No. 489,404, July 17, 1974, abandoned.

[52] U.S. Cl. ..... 26/18.5; 28/72 FT; 68/177

[51] Int. Cl.[2] ..... D06B 3/28

[58] Field of Search ..... 26/1, 18.5; 28/72 FT; 68/5 C, 177, 178

[56] References Cited

UNITED STATES PATENTS

| | | | |
|---|---|---|---|
| 2,972,177 | 2/1961 | Bidgood, Jr. | 26/1 |
| 3,510,251 | 5/1970 | Fujii et al. | 68/177 X |
| 3,511,068 | 5/1970 | Fujii | 68/177 |
| 3,587,256 | 6/1971 | Spara | 68/177 |
| 3,685,325 | 8/1972 | Carpenter | 68/177 |
| 3,696,645 | 10/1972 | Henningsen et al. | 68/177 |
| 3,718,012 | 2/1973 | Vinas | 68/177 X |
| 3,771,337 | 11/1973 | Trullas | 68/178 |
| 3,780,544 | 12/1973 | Turner et al. | 68/177 |

OTHER PUBLICATIONS

Richardson, G. M., *Knitted Stretch Technology*, N. Y., National Knitted Outerwear Association, 1965, Chapter 9, pp. 55–62.

*Primary Examiner*—Robert R. Mackey
*Attorney, Agent, or Firm*—Richards, Shefte & Pinckney

[57] ABSTRACT

Effective bulking or shrinking of textile fabric prior to wet processing is obtained by recirculating the textile fabric in continuous loop form under an aspirating influence induced with an inert gas while applying heat to the fabric for such bulking or shrinking.

3 Claims, 1 Drawing Figure

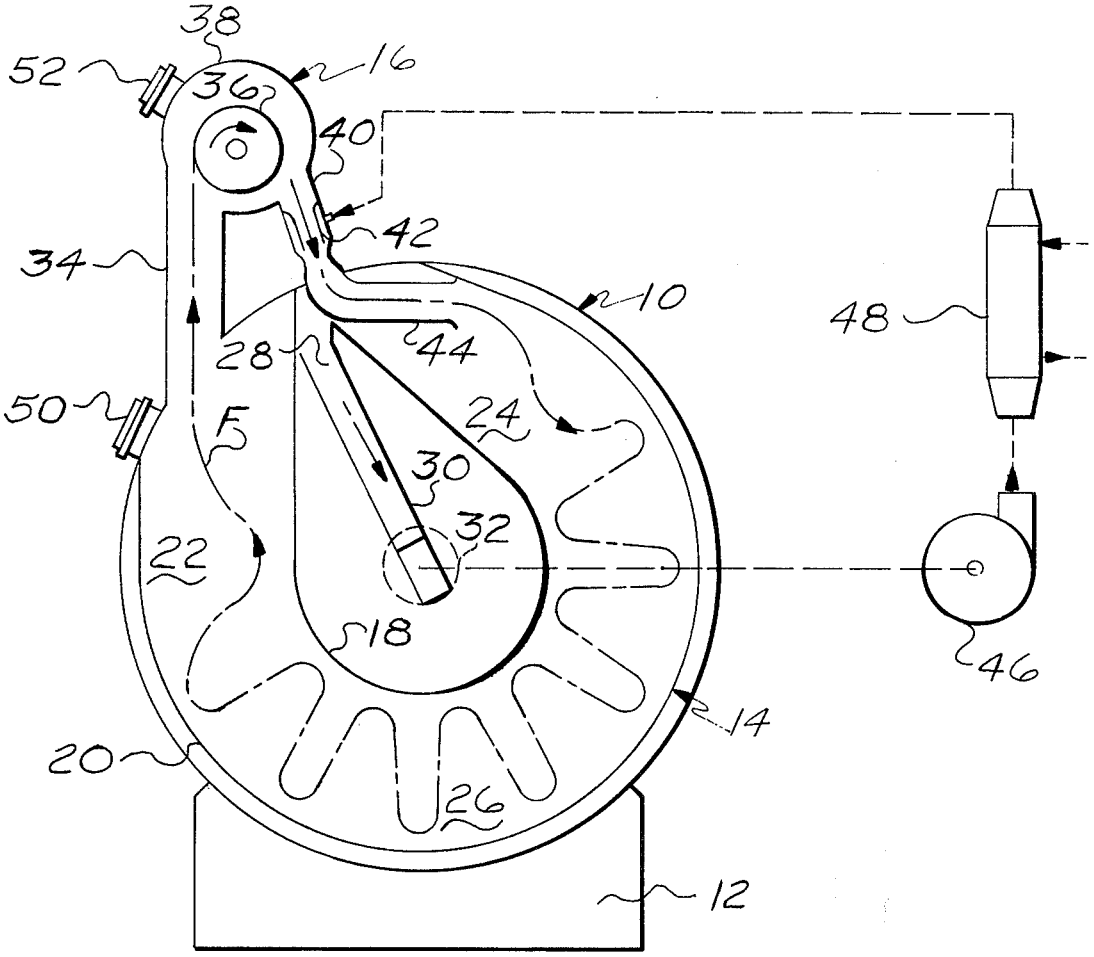
38
52
36
16
40
42
34
10
48
28
44
50
F
24
30
32
22
18
46
14
20
26
12

HEAT TREATMENT OF TEXTILE FABRIC PRIOR TO WET PROCESSING

CROSS-REFERENCES TO RELATED APPLICATIONS

This is a continuation of copending application Ser. No. 489,404, filed July 17, 1974, and now abandoned in favor of this application; Copending applications Ser. No. 381,268, filed July 20, 1973, now U.S. Pat. No. 3,921,420 granted Nov. 25, 1975 and Ser. No. 489,403 filed July 17, 1974 now U.S. Pat. No. 3,949,575 granted Apr. 13, 1976 both disclose apparatus that can be used for bulking or shrinking in accordance with the present invention and are of related interest for that reason.

BACKGROUND OF THE INVENTION

Because the elevated temperature conditions to which woven or knit textile fabrics are usually subjected during wet processing can have a significant physical effect on the fiber of which the fabrics are formed, it is common practice to employ a preliminary heat treatment whenever such an effect is expected. In the case of textured goods the effect of heat is one of bulking as a result of heat induced recovery of texture in the fiber that has been subdued or diminished in the course of fabric formation. If this bulking is not induced preliminarily, it will take place during wet processing and where such processing includes dyeing an uneven strike or coloring effect is virtually certain to result. In addition, many fabrics are subject to pronounced shrinkage during wet processing and must be heat treated preliminarily in order to provide adequate dimensional stability for suitable finishing. The latter effect often occurs in cotton and woolen goods and blends thereof.

According to prior practice, heat treatment of textile fabrics for prebulking or preshrinking has commonly been carried out either in a heated tumbling drum or a loop washer arrangement, both of which have imposed burdensome fabric handling problems. The present invention provides for such heat treatment in an exceptionally simple and effective manner.

SUMMARY OF THE INVENTION

According to the present invention, the art of heat treating textile fabric for prebulking or preshrinking the same is improved by recirculating the fabric in continuous loop form under an aspirating influence induced with an inert gas while applying heat to the fabric as required for the bulking or shrinking. By the term "inert gas", it is meant that the gas employed to provide the aspirating influence is inert with respect to the fabric being handled in the sense of having no unwanted reactive or other effect on the fabric. Normally the gas employed will be air, although one that is inert in the strict sense, such as nitrogen, can be used whenever there is reason to do so.

For handling the fabric loop during recirculation provision must be made as a practical matter for accumulating a predominant portion of the loop in a manner allowing progressive withdrawal and return of fabric from and to this accumulation by the recirculating aspiration. There are no special requirements to be met in making such provision other than the practical ones of handling the fabric loop satisfactorily during recirculation and confining the applied heat in reasonable fashion.

The heat needed for the fabric treatment can be applied by raising the temperature of the gas employed to induce the aspiration for recirculation, or by injecting steam at an appropriate point, or in any other way desired. Just how the heat is applied is not critical because recirculation of the fabric loop in accordance with the present invention renders heat application readily possible in a number of ways, and the advantage afforded by the invention is not in the particular mode of such application but in the effectiveness with which it may be done and in the greatly simplified and orderly handling of the fabric as it is done.

DESCRIPTION OF THE DRAWINGS

The single FIGURE of the drawing is a diagrammatic illustration of a suitable arrangement of apparatus for heat treating textile fabric in accordance with the present invention.

DETAILED DESCRIPTION OF THE INVENTION

The drawing diagram indicates an apparatus arrangement patterned along the lines of that disclosed in the above-noted copending application Ser. No. 489,403 which can also be used to practice the present invention but is more sophisticated for other purposes than is needed for the heat treating procedure of this invention. Accordingly, a considerably simpler arrangement is diagramed in the drawing for present purposes that includes an enclosing vessel 10 standing on a base 12 and containing a chamber 14 in the nature of a J-box for orderly accumulation of a predominant portion of a fabric loop F during recirculation of the loop by means arranged in a conduit superstructure 16 with which the vessel 10 is fitted in relation to the J-box chamber 14. The enclosing vessel 10 can be eliminated if the contained J-box chamber 14 is arranged to confine the applied heat satisfactorily, although the vessel 10 can be useful for heat application or conservation purposes when it is included.

In any event, the J-box chamber 14 is formed between spaced inner and outer shells 18 and 20 providing a vertically rising chamber portion 22 from which the fabric loop F is withdrawn by the recirculating means, an inclined chamber portion 24 at which the recirculating loop F is returned, and an arcuate chamber portion 26 in which a predominant portion of fabric loop F is transiently stored during recirculation. At the inclined entrance portion 24 of chamber 14, the inner shell 18 is arranged to form a throat 28 from which a duct 30 runs to a lateral outlet 32 in vessel 10 for a purpose that will appear presently.

The conduit superstructure 16 is fitted on the vessel 10 so that an entrance leg 34 thereof rises above chamber portion 22 to receive the fabric loop F for recirculation over a driven lifter roll 36 arranged in a junction housing 38 from which an inclined discharge leg 40, containing aspiration means 42, returns to vessel 10 and terminates in a horizontal fabric directing portion 44 within chamber portion 24. The aspirating means 42 normally has the form of a venturi, as illustrated, that is adapted for recirculating the fabric loop F in rope form, although it can be arranged instead for open width recirculation, or it can be formed by an arrangement of inert gas jets directed to produce the recirculating influence.

The inert gas for inducing aspiration is supplied by a blower 46 having its pressure leg connected through a heat exchanger 48 to the aspirating means 42, while having its suction leg arranged to draw at the previously mentioned lateral outlet 32 of vessel 10 so as to form a closed loop in which the aspiration discharge is recovered through the duct 30 extending from the throat 28 at chamber portion 24. Loading and removal of fabric loop F are provided for by access ports 50 and 52 suitably arranged as fittings on both the vessel 10 and the superstructure 16.

Typical operating procedure according to the present invention involves loading the fabric loop F with the driven lifter roll 36 running and blower 46 operating to produce the aspirating influence. During the loading step, temperature conditions should be maintained in the range of about 80° to 140° F. Loading at a temperature toward the upper end of this range is usual as successive loads are processed. Upon completion of the loading step, the aspiration influence and operating speed of lifter roll 36 are adjusted so that a recirculating cycle of the fabric loop F occurs every 30 to 120 seconds, and processing temperature is then increased as required for bulking or shrinking the particular material being handled. Usually the temperature required will be in the range from about 225° to 250° F., although it may on occasion be as low as about 140° F. or as high as about 300° F. Recirculation at this increased temperature is continued for about 10 to 60 minutes, again depending on the requirements of the particular material being handled. Upon sufficient heat treatment at the increased temperature to achieve the effect desired, the operating temperature is decreased within the previously noted range suitable for loading and the fabric loop F is either unloaded, or subjected to further processing if the equipment employed has such capability as is the case with that disclosed in the earlier-noted copending application Ser. No. 489,403. The decrease in operating temperature can be effected by cooling at heat exchanger 48, or by simply opening the equipment to the atmosphere and circulating ambient air therein. The heat exchanger use is preferable, however, because some materials are apt to require a controlled cooling rate for satisfactory results and control in this respect is difficult without a regulated heat exchange influence.

The present invention has been described in detail above for purposes of illustration only and is not intended to be limited by this description or otherwise to exclude any variation or equivalent procedure that would be apparent from, or reasonably suggested by, the foregoing disclosure to the skill of the art.

We claim:

1. In the art of heat treating textile fabric for bulking or shrinking the same prior to wet processing, the improvement which comprises the combined steps of handling said fabric as a rope in endless loop form by confining a major portion of the fabric loop as a plaited accumulation in a chamber from which the loop is progressively withdrawn and then returned, recirculating the textile fabric endless loop from and to said plaited accumulation free of nip constraint under an aspiration influence induced with a jetted inert gas while applying heat for said treatment to said textile fabric during such recirculation, and continuing said heat application and recirculation until the desired bulking or shrinking has been effected.

2. In the art of heat treating textile fabric for bulking or shrinking the same prior to wet processing, the improvement defined in claim 1 wherein the inert gas employed to induce said aspiration influence is air.

3. In the art of heat treating textile fabric for bulking or shrinking prior to wet processing, the improvement defined in claim 2 wherein the air employed to induce said aspiration influence is heated for applying the treatment heat to said textile fabric during recirculation.

* * * * *